US007946145B2

(12) United States Patent
Gober

(10) Patent No.: US 7,946,145 B2
(45) Date of Patent: May 24, 2011

(54) METHOD AND APPARATUS FOR BLOWING OUT AND/OR FOR SPRAYING DIES OF A FORGING PRESS

(75) Inventor: Norbert Gober, Odenthal (DE)

(73) Assignee: SMS Eumuco GmbH, Leverkusen (DE)

( * ) Notice: Subject to any disclaimer, the term of this patent is extended or adjusted under 35 U.S.C. 154(b) by 425 days.

(21) Appl. No.: 12/093,700

(22) PCT Filed: Nov. 7, 2006

(86) PCT No.: PCT/DE2006/001957

§ 371 (c)(1),
(2), (4) Date: May 14, 2008

(87) PCT Pub. No.: WO2007/056975

PCT Pub. Date: May 24, 2007

(65) Prior Publication Data

US 2008/0236229 A1 Oct. 2, 2008

(30) Foreign Application Priority Data

Nov. 15, 2005 (DE) ..... 10 2005 054 352

(51) Int. Cl.
*B21B 45/02* (2006.01)

(52) U.S. Cl. ..... 72/43; 72/342.3

(58) Field of Classification Search ..... 72/39, 41, 72/43, 342.3, 361, 419, 420, 422; 184/6.14, 184/6.19

See application file for complete search history.

(56) References Cited

U.S. PATENT DOCUMENTS 3,248,762 A * 5/1966 Wagner ..... 164/158
3,282,079 A 11/1966 Stimson ..... 356/222
3,633,651 A * 1/1972 Ruhlandt ..... 164/267
4,284,670 A * 8/1981 Kole ..... 427/422
4,312,210 A * 1/1982 Nishizawa et al. ..... 72/267
4,463,587 A 8/1984 Werner ..... 72/4
4,520,643 A 6/1985 Werner ..... 72/39

(Continued)

FOREIGN PATENT DOCUMENTS

DE 4326924 2/1995

(Continued)

*Primary Examiner* — Edward Tolan
(74) *Attorney, Agent, or Firm* — Andrew Wilford

(57) ABSTRACT

In a method for blowing out and/or for spraying dies (3, 5), arranged at the top and/or bottom, of forging presses, in particular drop forging presses, comprising automatic workpiece transport by means of a transport lifting beam (8) provided with gripping devices (9) and comprising a mechanical blow-out and spray device (11; 10) which is introduced into the tool space (1) of the forging press and is withdrawn again from the latter, a spray lifting beam (11) provided with spray devices (10) is moved into the tool space (1) synchronously with the lifting and removal movement of the transport lifting beam (8), but independently of the latter, while the transport lifting beam (8) lifts a workpiece (6) produced in a preceding forging operation and removes it from the tool space (1), wherein the spray devices (10) are actuated within the tool space and the forging dies (3, 5) are lubricated and/or cooled close to the contour. An apparatus used for this purpose is distinguished by the fact that a separate spray lifting beam (11) formed with spray devices (10) that can be actuated temporarily is assigned to the transport lifting beam (8), wherein the drives of the two lifting beams (8; 11) are synchronized with opposed sequences of movement via an automatic lifting beam mechanism and the lifting beams (8; 11) are connected for their activation to a common open-loop and closed-loop control device (12).

7 Claims, 3 Drawing Sheets

U.S. PATENT DOCUMENTS 4,586,365 A * 5/1986 Henkelmann ..... 72/405.13
4,759,703 A * 7/1988 Krebser et al. ..... 425/90
4,840,052 A 6/1989 Takata ..... 72/45 P
4,966,274 A 10/1990 Willenbrock ..... 198/621.2
5,535,613 A * 7/1996 Yano ..... 72/342.3
5,642,637 A * 7/1997 Crum ..... 72/43

FOREIGN PATENT DOCUMENTS

JP 58-167047 * 10/1983
JP 59-82133 * 5/1984

* cited by examiner

METHOD AND APPARATUS FOR BLOWING OUT AND/OR FOR SPRAYING DIES OF A FORGING PRESS

CROSS REFERENCE TO RELATED APPLICATIONS

This application is the US national phase of PCT application PCT/DE2006/001957, filed 7 Nov. 2006, published 24 May 2007 as WO 2007/056975, and claiming the priority of German patent application 102005054352.9 itself filed 15 Nov. 2005, whose entire disclosures are herewith incorporated by reference.

FIELD OF THE INVENTION

The invention relates to a method of and apparatus for blowing out and/or spraying upper and lower dies of a forging press, particularly of a drop-forging press comprising an automatic workpiece conveyor with a vertically shiftable conveying device provided with a grab, and comprising a mechanical blow-out and vertically shiftable spraying device that is introduced into the work space of the forging press and is withdrawn again therefrom.

BACKGROUND OF THE INVENTION

In a drop-forging press comprising an automatic workpiece conveyor, it is common to transport the workpieces from one work station to the next work station by means of a lifting mechanism. Different types or models of lifting mechanisms are known in the prior art for the transporting of workpieces, such as a lifting mechanism comprising two parallel lifters from DE 37 21 694 [U.S. Pat. No. 4,966,274], each provided with grabs in order to be able to grip the workpieces between the lifters, lift them from the die, and transport them to the next work station. Another model of lifting mechanism incorporates only one lifter provided with a grab.

In operation with the automatic workpiece conveyor using the above mentioned lifting mechanisms within the work space of a drop-forging press, there is no stopping between forging of parts, but instead, the workpiece conveyor runs continuously. Forging is usually done with every other forging operation, i.e. only every second closing of the die is effective on a workpiece during the automatic process.

The blowing-out and/or spraying of the dies, which is indispensable in forming machines producing workpieces in a continually repeated manner, can be carried out in this case only if the dies are clear and no press stroke is currently being performed. Known electrically, pneumatically, or hydraulically controlled spray arms, which are provided with spray nozzles, can therefore only move into the work space or extend into the work space if the press ram assumes its idle position in the upper dead center. This means that a significant part of the blow-out and/or spray time that is already short is lost due to control and monitoring times. A spray arm apparatus operated in such a manner is known from DE 32 30 095 [U.S. Pat. No. 4,520,643].

DE 38 44 262 [U.S. Pat. No. 4,840,052] discloses mobile spray nozzle devices that operate in a timed manner on actuation of the press ram in order to move spray nozzles into the space between the upper and lower die parts that are separated. This apparatus utilizing a carriage that is displaceable via a hydraulic or pneumatic actuator, or a cam mechanism driven by means of the drive shaft of a moving apparatus, requires an actuation time that is too long, of 1.5 to 2 seconds on average for the performance of one work cycle, i.e. movement through one forward stroke and one backward stroke for inserting the spray nozzle apparatus between the die parts and its subsequent removal.

OBJECT OF THE INVENTION

The invention therefore has the object of creating a method and apparatus of the above-mentioned type that enable a quicker cooling and/or lubrication of the dies that is particularly better adjusted to the cycle times of the automatic workpiece conveyor.

SUMMARY OF THE INVENTION

This object is attained according to the invention in that while the conveying device raises a workpiece produced in a preceding forging process, and transports it away from the work space, a raisable and lowerable spraying device provided with spray nozzles is moved synchronously with the lifting and transporting movement of the conveying device, but is moved independently of same into the work space, the spraying nozzles are actuated within the work space, and the forging dies are cooled and/or lubricated from very close. In this method the start of the cycle of the conveying device and of the spraying device occurs simultaneously from their respective standby positions outside the dies, while the subsequent longitudinal and transverse movements and the upward and downward movements of both lifting beams can be performed in a coordinated process, but completely independently of each other.

This allows for the fact that while the conveying device raises the gripped workpiece from the die in a lifting movement, the spray beam can simultaneously move toward the work space between the opened dies. As soon as the conveying device has exited the work space with the workpiece in a longitudinal or transverse movement, the spray beam, together with the spraying nozzles it carries is completely introduced into the work space, and the cooling and/or lubricating process can be started immediately. In this manner the transport phase of the tool can be transferred to one of the next work stations from the beginning, together with the courses of movement for the cooling and/or lubricating of the dies.

A preferred embodiment of the invention provides that the spraying device performs a lowering movement and/or a downward is movement within the work space. In this manner the spraying nozzles can be positioned particularly close, at an optimum spacing from the tool surfaces, or the cavities of the dies.

According to a further advantageous disclosure of the invention the conveying device and the spraying device are moved oppositely to each other. In this manner an uninterrupted movement is achieved, since the work space successively becomes increasingly free for the simultaneously inwardly moving spraying device on outward movement of the conveying device.

Furthermore, the method according to the invention provides that the conveying device moves the picked-up forged workpiece during the cooling and/or lubricating phase to the next work station, and deposits it there, then receives a workpiece blank, and transports it into the work space, the spraying nozzles simultaneously being switched off, and the spray beam moves out of the work space. This interplay between the workpiece conveyor to the next work station, utilization of this transport phase for cooling and/or lubricating the tools, and the transport of a new workpiece blank into the work station with simultaneous movement of the spraying device from the work space of this work station is continually repeated at the predetermined frequency of the continuously reciprocating mechanism of the two lifting beams coordinated to each other in their travels, depending on the desired production output of the forging press.

An apparatus for carrying out the method provides that a separate spraying device embodied with spraying nozzles that can be actuated temporarily is assigned to the conveying device, the drives of the two lifting beams being synchronized with opposite movements by an automatic lifting mechanism and the lifting beams are connected for their activation to a common controller operating with or without feedback. The synchronization of the drives via the mutual servo-electrical control and regulating apparatus ensures that the two lifting beams, which are incorporated into a lifting mechanism for the automatic workpiece conveyor, start precisely at the same time with the sequences of movement predetermined by the lifting mechanism.

The sequences of movement of the conveying device and of the spraying device required for the simultaneous transport of the workpieces and for cooling and/or lubricating the tools differ. As soon as the conveying device carries out a longitudinal or transverse movement from the work space with the lifted workpiece, the spraying device increasingly moves with its spraying nozzles into the newly free work space.

For this purpose, the lifting mechanism preferably operates together with an electro-hydraulic drive apparatus, changes in the movement sizes, in the associations of the movements to the individual movement axes to each other, and changes of movement speeds in the individual movement axes being controlled exactly. As an alternative, an electro-hydraulic drive apparatus can be provided.

The actuation of the lifting beams, or of the lifting mechanism, is carried out by servo-electric control and regulating apparatus, in which the set-point and actual values of the movement axes of the lifting beams and of the entire press process are continually detected and processed.

BRIEF DESCRIPTION OF THE DRAWING

Further characteristics and details of the invention are obvious from the claims and the description of an embodiment of the invention illustrated in the drawings below. Therein:

SPECIFIC DESCRIPTION

Figure 1:
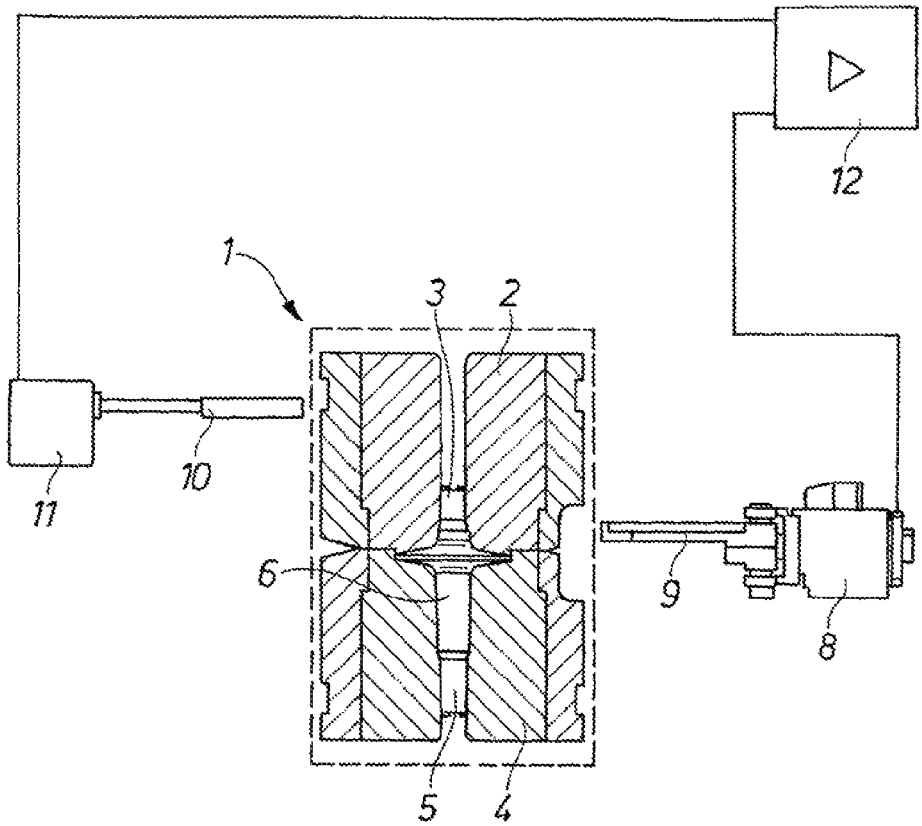
FIGS. 1 to 4 show sequential workpiece movements from the work space of a drop-forging press and a cooling and lubricating process of dies provided in the work space by means of a conveying device on one hand, and a spraying device on the other hand.
Figure 2:
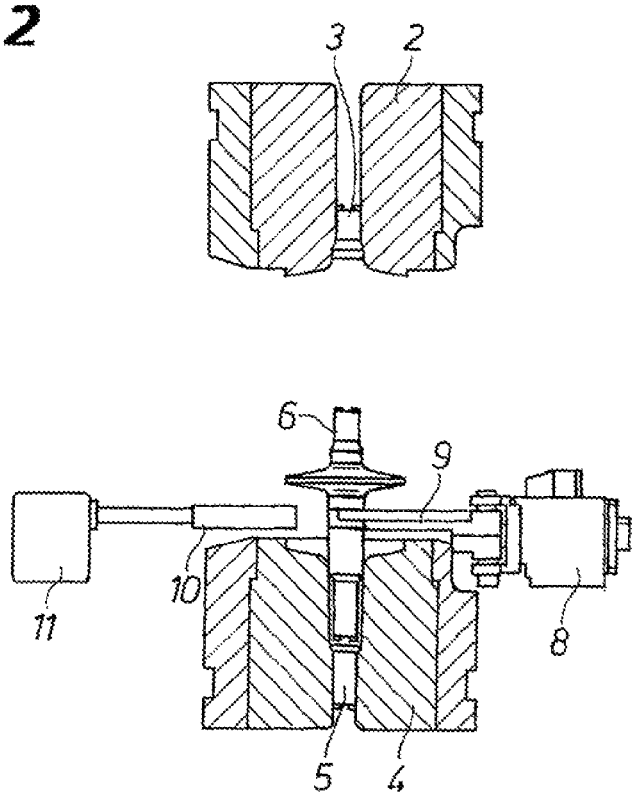
Figure 3:
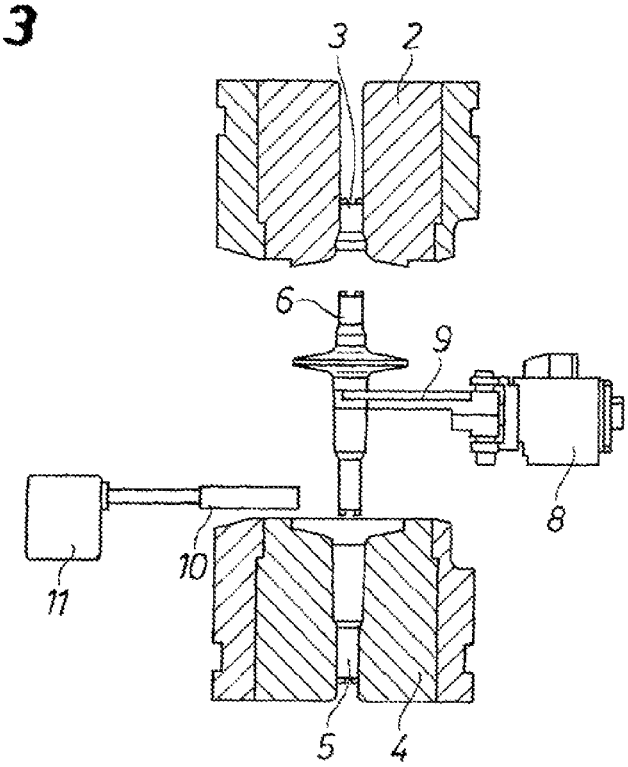

A drop-forging press, not illustrated in detail in FIGS. 1 to 4, comprises an upper tool holder 2 in a work space 1 holding an upper tool with an upper die 3 and a lower tool holder 4 holding a lower tool with a lower die 5, the upper tool holder 2 being movable up and down, for example by means of a press ram or piston rod.

The automatic transport of a forged workpiece 6 from one work station to the next work station, or from the die 5 to a subsequent die 7 (see FIGS. 5, 5*a*) is carried out by means of a conveying device 8 that is moved by a drive that is not illustrated. The conveying device 8 is provided with a grab 9 for the safe gripping, holding, and carrying of the workpiece 6.

A raisable and lowerable spraying device 11 provided with a spray beam 10 is provided on the side of the work space 1 opposite the conveying device 8 for cooling and/or lubricating and/or blowing out the upper and lower dies 3 and 5. The spraying device 11 is also actuated by a drive that is incorporated into the lifting mechanism for coordinating the sequence of movements of the conveying device 8, but that is separately programmable. The lifting mechanism is actuated by a control and regulating apparatus 12 that continually detects and compares the set-point and actual values of the movement axes of the conveying device 8 and of the spraying device 11, the beginning and the end of the pressing or forging process, and the position of the press ram, and controls the uninterrupted, automatic workpiece conveyor and the cooling and/or lubricating process of the upper and lower dies 3 and 5 occurring parallel thereto.

Both the conveying device 8 and the spraying device 11 are positioned outside the work space 1 in stand-by mode (see FIG. 1) during a forging process. After the forging process has been completed and the upper tool holder 2 has reached its upper idle position with the upper die 3, the conveying device 8 moves into the work space 1, grips the previously forged workpiece 6 by means of the grab 9, raises it, and moves it in a straight line out of the work space 1 (see FIGS. 2, 3, and 4). FIG. 5 schematically shows a transverse moving-in path 13, a vertical lifting path 14, and a transverse moving-out path 15.

Figure 4:
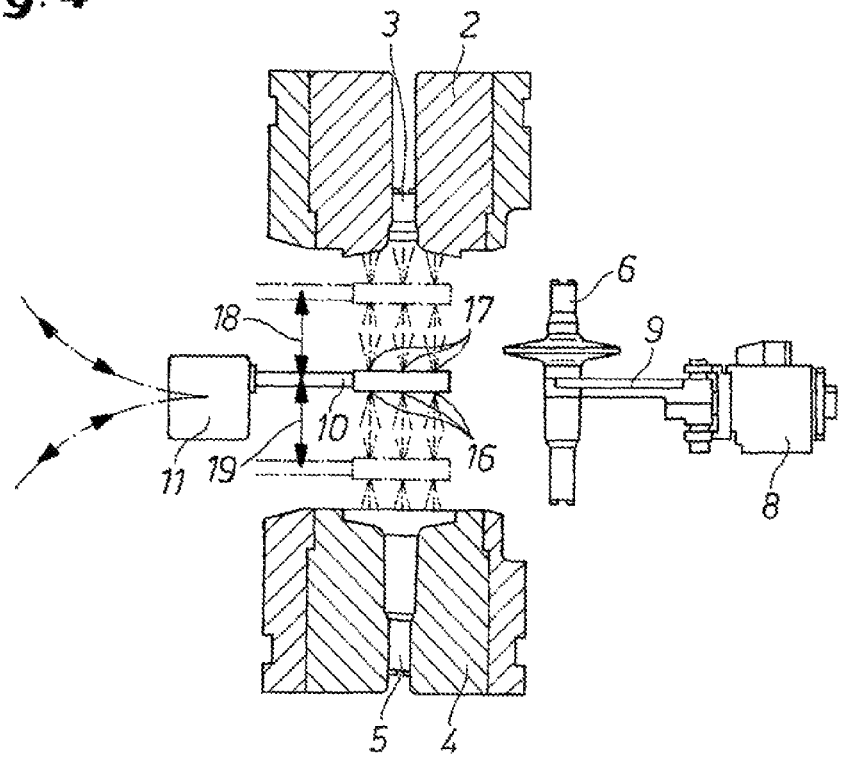
Figure 5:
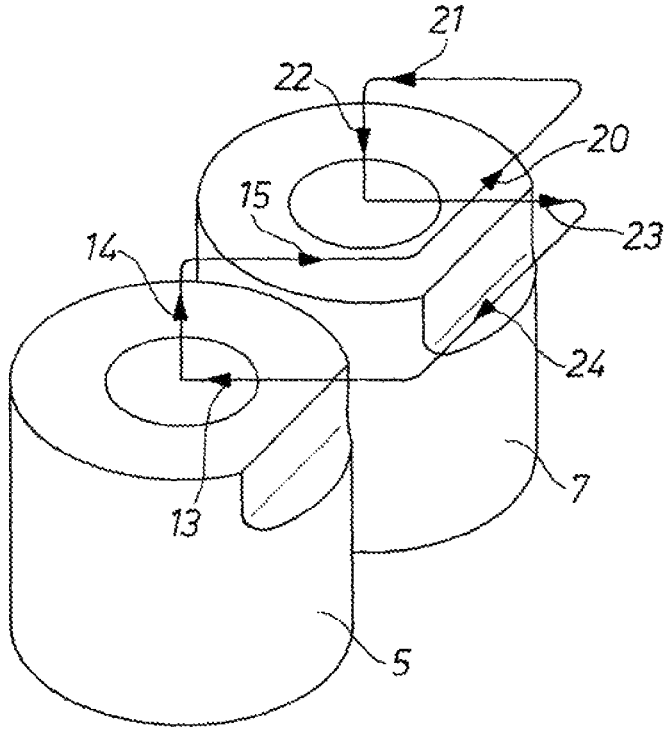
FIGS. 5 and 5*a* schematically show sequences of movement of the conveying device.

Synchronously and simultaneously to the return movement of the conveying device 8 out of the work space 1, the spraying device 11 moves horizontally transversely into the work space 1 with its spray nozzle 10 with lower and upper spray ports 16 and 17 and moves through a vertical lifting path 18 and a vertical lowering path 19 during which the upper and lower dies 3 and 5 are blown out and sprayed (see FIG. 4).

Figure 5A:
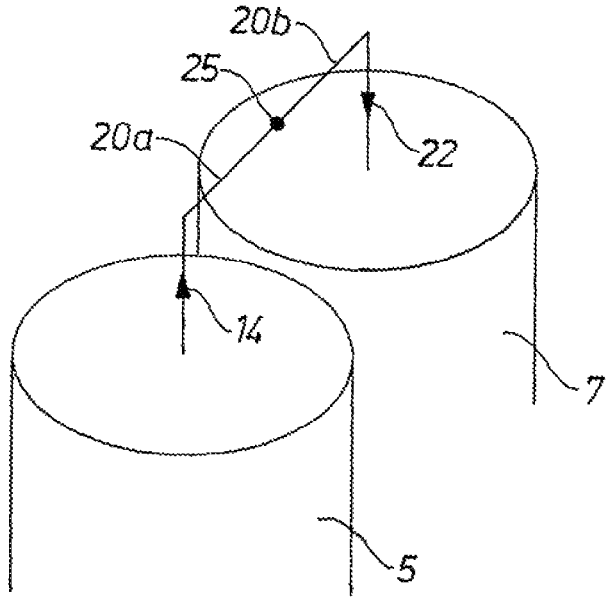

During this spray phase the conveying device 8 continues its transport phase outside the work space 1, and moves longitudinally to the next work station, or to the next die 7 with the workpiece 6 (see FIG. 5). There, it carries out an inward transverse movement beyond the center of the die, deposits the workpiece 6 in the die 7 by means of a downward movement, exits the die 7 in an outward transverse movement, and carries out a longitudinal movement back to the lower die 6 in the work space 1. FIG. 5 schematically shows how the conveying device moves through a forward longitudinal path 20, a transverse inward path 21 to the die, a downward path 22, a transverse outward path 23, and a longitudinal rearward path 24. FIG. 5 also shows that both the longitudinal movement toward the lower die 7 and the longitudinal movement back to the lower die 5 of the conveying device 8 take place outside the work space of the lower dies 5 and 7. FIG. 5*a* shows that the longitudinal movement from the lower die 5 to the lower die 7 is divided into movement paths 20*a* and 20*b* separated at a rest point 25. This rest point 25 is a programmed stop point of the lifting mechanism, at which the automatic sequence of the transport is interrupted.

During transport of the workpiece 6 to the lower die 7 and return of the conveying device 8 back to the work space 1, the spraying device 11 is withdrawn from the work space 1 until it again resumes its stand-by position outside the work space 1. The conveying device 8 is also withdrawn to this position after it has deposited the workpiece into one of the dies 3 or 5 so that a new workpiece blank is forged, and the interplay between the transport phase to the next work station, and the movement phase of the spraying device 11 for the cooling and/or lubricating of the dies 3 and 5 occurring synchronously, can be repeated.

The invention claimed is:

1. A method of operating a forging press having:

an upper upstream forging die and a lower upstream forging die in an upstream work space, one of the dies being movable in the upstream space toward and away from the other of the dies between an open position and a closed position;

a conveying device having a vertically and horizontally displaceable grab movable in the open position of the upstream dies between an inner position in the work space between the dies engaging a workpiece in the lower die and an outer position out of the work space; and a spraying device including a vertically and horizontally displaceable sprayer movable between an inner position in the work space between the dies and an outer position out of the work space, the method comprising the steps of sequentially:

a) after a forging operation and movement of the dies into the open position, moving the grab from the respective outer position into the respective inner position, engaging the grab with a workpiece in the lower die, raising the workpiece out of the lower die with the grab, and then moving the workpiece and the grab from the respective inner position toward the respective outer position; and b) as the grab, after moving into the respective inner position, engages the workpiece and lifts it and then moves with it from the respective inner position to the respective outer position, moving the sprayer synchronously from the respective outer position to the respective inner position, thereby engaging the sprayer between the dies, and c) thereafter spraying the dies with the sprayer.

2. The method defined in claim 1, further comprising the step of shifting the sprayer vertically while spraying the dies.

3. The method defined in claim 2 wherein the sprayer is moved vertically into close juxtaposition with an upper surface of the lower die and also with a lower surface of the upper die.

4. The method defined in claim 1 wherein the press has in a downstream work space adjacent the upstream space an upper downstream forging die and a lower downstream forging die, one of the downstream dies being movable in the downstream space toward and away from the other downstream die between an open position and a closed position, the method further comprising the steps of sequentially:

a') after step a) and movement of the downstream dies into the respective open position, shifting the grab with the workpiece downstream to a position in the downstream work space and depositing the workpiece in the lower downstream die;

a") picking up a workpiece blank from outside both work spaces, moving it into the upstream work space, and depositing it in the upstream lower die;

b') after step b and before the workpiece blank is moved into the upstream work space, shifting the sprayer from the inner position into the outer position.

5. The method defined in claim 4, further comprising the step of turning the sprayer on after it is moved into the upstream work space and turning it off before moving it out of the upstream work space.

6. The method defined in claim 2 wherein the grab is moved horizontally and transversely between the respective outer and inner positions adjacent each of the work spaces and is moved horizontally and longitudinally between the work spaces but not between the dies.

7. The method defined in claim 6 wherein the grab when moving from the upstream work space to the downstream workspace with the grab moves at a predetermined upper level and when moving from the downstream workspace back to the upstream work space moves at a predetermined lower level below the upper level.

* * * * *